US005085423A

United States Patent [19]

Nishimoto et al.

[11] Patent Number: 5,085,423

[45] Date of Patent: Feb. 4, 1992

[54] SHEET FEEDING DEVICE

[75] Inventors: Yoshifumi Nishimoto, Yokohama; Masahiko Igaki, Tokyo; Kenichi Kataoka; Naruto Sugimoto, both of Yokohama; Hiroyuki Seki, Urawa; Atsushi Kimura, Yokohama, all of Japan

[73] Assignee: Canon Kabushiki Kaisha, Tokyo, Japan

[21] Appl. No.: 544,380

[22] Filed: Jun. 27, 1990

[30] Foreign Application Priority Data

Jun. 28, 1989 [JP] Japan ..... 1-166455

[51] Int. Cl.[5] ..... B65H 5/10

[52] U.S. Cl. ..... 271/266; 271/18.2; 271/42; 271/267

[58] Field of Search ..... 271/18.1, 18.2, 267, 271/268, 193, 84, 42

[56] References Cited

U.S. PATENT DOCUMENTS

| | | | |
|---|---|---|---|
| 4,692,652 | 9/1987 | Seki et al. | 310/323 |
| 4,955,598 | 9/1990 | Hiroshige | 271/267 |

FOREIGN PATENT DOCUMENTS

| | | | |
|---|---|---|---|
| 3312037 | 2/1984 | Fed. Rep. of Germany . | |
| 59-177243 | 10/1984 | Japan . | |
| 247242 | 10/1988 | Japan | 271/18.2 |
| 247243 | 10/1988 | Japan | 271/18.2 |
| 1364390 | 8/1974 | United Kingdom . | |
| 2125375 | 3/1984 | United Kingdom . | |

*Primary Examiner*—Richard A. Schacher

*Attorney, Agent, or Firm*—Fitzpatrick, Cella, Harper & Scinto

[57] ABSTRACT

An improved sheet feeding device of this invention includes a variable pressure applying unit for changing a contact pressure between a sheet and vibration members.

12 Claims, 3 Drawing Sheets

SHEET FEEDING DEVICE

BACKGROUND OF THE INVENTION:

1. Field of the Invention

The present invention relates to a sheet feeding device for moving a sheet such as a paper sheet and, more particularly, to a sheet feeding device suitable as a paper sheet feeding device used in equipment such as a calculator, a copying machine, a facsimile apparatus, a word-processor, and a typewriter.

2. Related Background Art

A conventional sheet feeding device for clamping a sheet such as a paper sheet between a pair of vibration members such as piezoelectric elements to generate travelling vibrations and for feeding the sheet is proposed by the present assignee. A prior-art invention of a sheet feeding device proposed by the present assignee is disclosed in Japanese Patent Laid-Open No. 59-177243.

FIG. 2 is a view showing an arrangement of the sheet feeding device disclosed in Japanese Patent Laid-Open No. 59-177243.

Referring to FIG. 2, vibration elements 3 and 4 such as piezoelectric or electrostrictive elements are fixed on a vibration member 1, and a similar vibration element 5 (although one more element is actually provided, it is not illustrated in FIG. 2) is fixed to a vibration member 2. A supporting member 6 supports the vibration member 1 and biases the vibration member 1 against a sheet S. A housing base plate 7 partially constitutes a housing of the sheet feeding device. The vibration member 2 is fixed on the base plate 7. Side plates 8 and 9 are fixed on the base plate 7 and the supporting member 6. In this device, an AC voltage having a frequency (a natural frequency of one of the vibration members in practice) near the natural frequencies of both the vibration members is applied to one vibration element of each of the vibration members, while an AC voltage having a phase shifted from that of the AC voltage applied to one vibration element by $\pi/2$ from a $\pi/2$ shifter is applied to the other vibration element of each vibration member, so that travelling vibration waves are generated on the vibration members symmetrically about a sheet feeding surface. Each point of the surface of each vibration member opposite to the surface having the vibration elements is subjected to a kind of elliptical motion, and the points of the opposite surfaces of the vibration members are subjected to elliptical motion symmetrically about the sheet feeding surface. Therefore, the sheet can be fed by a frictional force.

FIG. 3 is a schematic view for explaining the principle of generating a sheet feeding force upon generation of travelling vibration waves. Assume that the sheet S is clamped by the vibration members 1 and 2 at an appropriate urging force, and that travelling vibrations are generated by the vibration members 1 and 2, as shown in FIG. 3. At this time, a given mass point on the surface of each of the vibration members 1 and 2 is taken into consideration. This mass point generally performs motion which traces an elliptical track. For example, in the vibration member 1, when the travelling vibration wave propagates in the right direction indicated by an arrow →, the mass point on the surface traces the elliptical track in the clockwise direction. Since the phases of the applied voltage components applied to the vibration members are controlled to have a spatial phase deference of 180°, the travelling vibration waves of the vibration members are symmetrical about the sheet, so that the projections of the opposite surfaces always contact each other through the sheet. A moving direction of each mass point corresponding to the projection portion of each of the vibration members 1 and 2 is opposite to a vibration propagating direction. In this case, a sheet feeding force is generated in a direction indicated by an arrow ←. In recessed portions of the surfaces with respect to the sheet, a sheet feeding force in the same direction as the wave propagating direction is generated. However, this sheet feeding force is smaller than that generated by the projection portions. A total sheet feeding force acts in a direction opposite to the travelling vibration wave propagating direction.

FIG. 4 shows another conventional sheet feeding device arranged based o the sheet feeding principle described above. This device is also proposed by the present assignee. In this sheet feeding device, vibration members comprise a pair of annular vibration members 10 and 11 each having a planar shape like a running track, as shown in FIG. 4. Vibration elements 12 and 13 such as piezoelectric or electrostrictive elements are fixed on the nonopposing surfaces of the annular vibration members. The electrostrictive elements 12 and 13 are divided into two groups. An AC voltage having a phase difference of 90° from that of an AC voltage applied to the one group is applied to the other group. When AC voltages having different phases are applied to the two groups of the electrostrictive elements 12 and 13, travelling bending vibrations which propagate along the circumferential direction of the annular vibration members 10 and 11 are generated by the vibration members 10 and 11, and a sheet S receives a force opposite to the travelling bending vibration propagating direction from the annular vibration members and is moved. The sheet feeding device using the annular vibration members having a shape like a running track utilizes travelling flexture motion of the linear portions of the vibration members as a sheet feeding force. In this sheet feeding device, the linear portions of the vibration members are arranged to be parallel to the sheet feeding direction. When the two linear portions of each of the annular vibration members 10 and 11 are in contact with the sheet in the sheet feeding device, the sheet receives the opposite direction forces and cannot be fed. In this device, only linear portions 10*a* and 11*a* of the vibration members 10 and 11 are kept in contact with the sheet S, and other portions including linear portions 10*b* and 11*b* have a thin wall so as to prevent them from contacting the sheet S.

In this device, when cyclic travelling vibration waves of the annular vibration members 10 and 11 in a direction indicated by an arrow $f_1$ are generated, the sheet S is fed in a direction of an arrow $f_2$ opposite to the propagation direction of the travelling vibration wave (i.e., the direction of the arrow $f_2$ is a direction toward the upper surface of the drawing of FIG. 5).

Sheets having different thicknesses and different mechanical characteristics are used in various types of office equipment including the sheet feeding devices described above. For example, an overhead projector uses a resin sheet having properties greatly different from those of normal paper. Since such a resin sheet has a much smaller coefficient of surface friction than that of the normal paper, a sheet feeding device must have a function corresponding to the resin sheet in order to feed the resin sheet as in the case of normal paper.

Since the conventional sheet feeding devices are designed under the assumption that sheets to be fed have predetermined thicknesses and predetermined coefficients of friction, these devices cannot be applied to all kinds of sheets.

SUMMARY OF THE INVENTION

It is an object of the present invention to provide a sheet feeding device which ca efficiently feed various sheets having different coefficients of friction and different thicknesses.

DESCRIPTION OF THE PREFERRED EMBODIMENT

Figure 1:
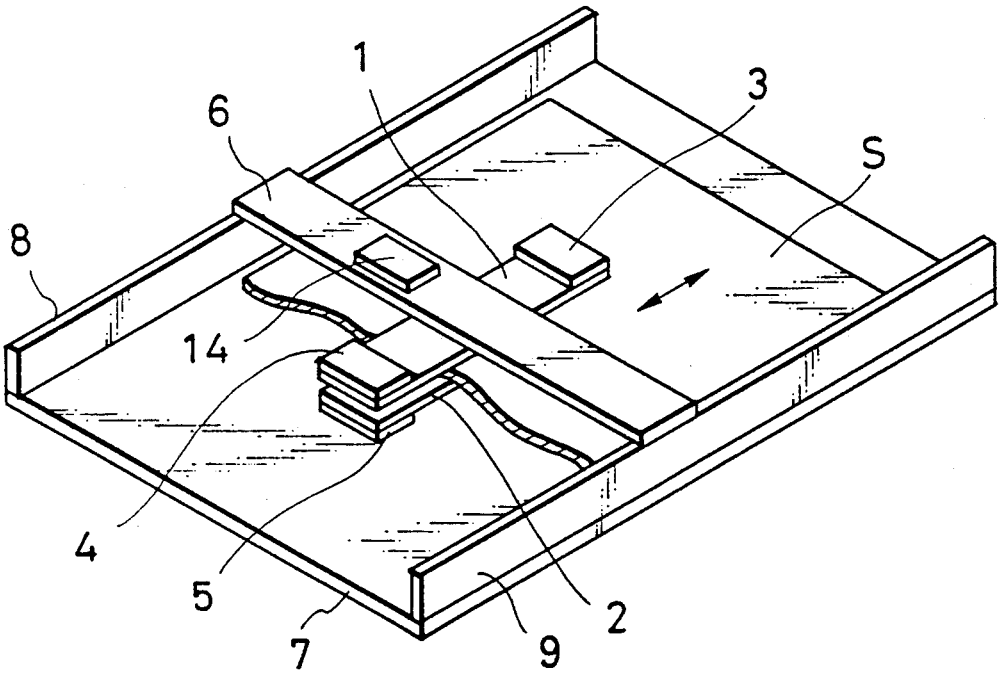
FIG. 1 is a perspective view showing a sheet feeding device according to an embodiment of the present invention.
Figure 2:
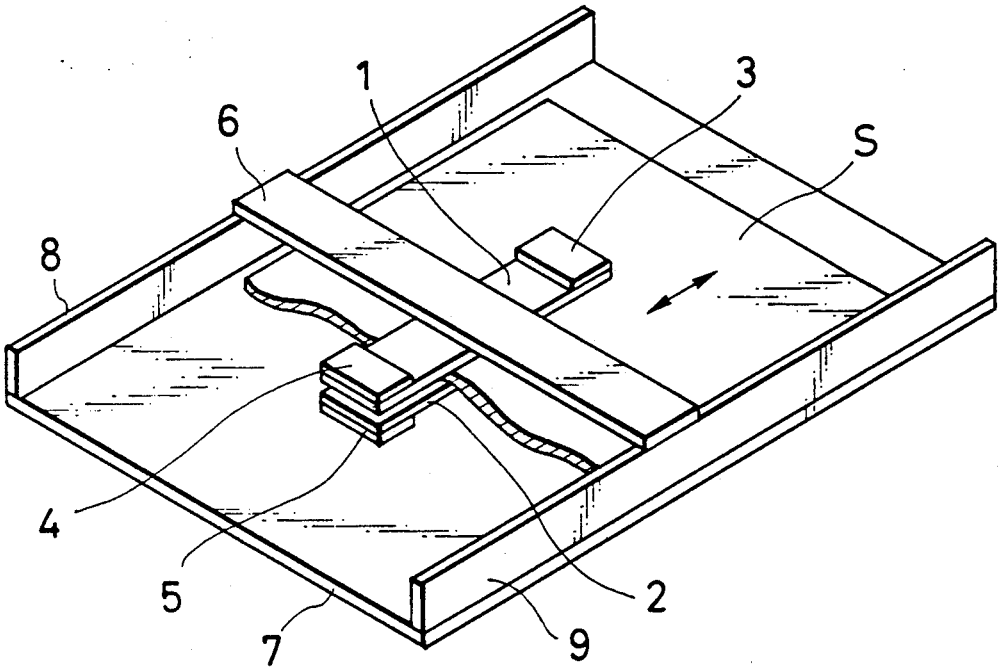
FIG. 2 PRIOR ART
FIG. 2 is a perspective view showing a conventional sheet feeding device.
Figure 3:
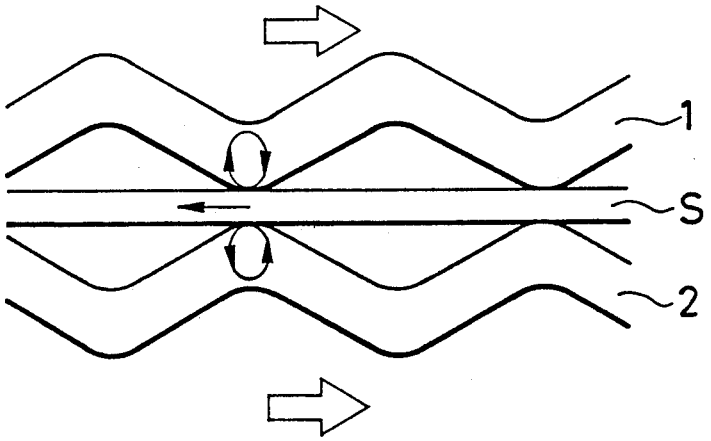
FIG. 3 is a view for explaining the principle of sheet feeding in the conventional sheet feeding device and the sheet feeding device of the present invention.

FIG. 1 is a perspective view showing an embodiment of a sheet feeding device which employs the present invention. The same reference numerals as in FIG. 2 denote the same constituting parts of the conventional device in FIG. 1, and a detailed description thereof will be omitted.

Referring to FIG. 1, a supporting member 6 constitutes part of a biasing means for biasing a vibration member 1 against a sheet S. An electro-mechanical energy conversion element 14 consisting of a piezoelectric or electrostrictive element is fixed on the supporting member 6. Voltages having different amplitudes can be applied from a power source (not shown) to the element 14 through a control circuit (not shown). When a voltage is applied to the element 14, an external force is generated by the element 14 in a direction (i.e., a direction for deflecting the support member 6 downward) perpendicular to a voltage application direction. When the supporting member 6 is deflected, the vibration member 1 is moved downward to increase a contact pressure between the vibration member 1 and the sheet S. As a result, a gripping force generated by the vibration members 1 and 2 is increased, and slippage between the sheet S and the vibration members can be reduced. Therefore, a sheet feeding speed, feeding efficiency, and the like can be improved.

Figure 4:
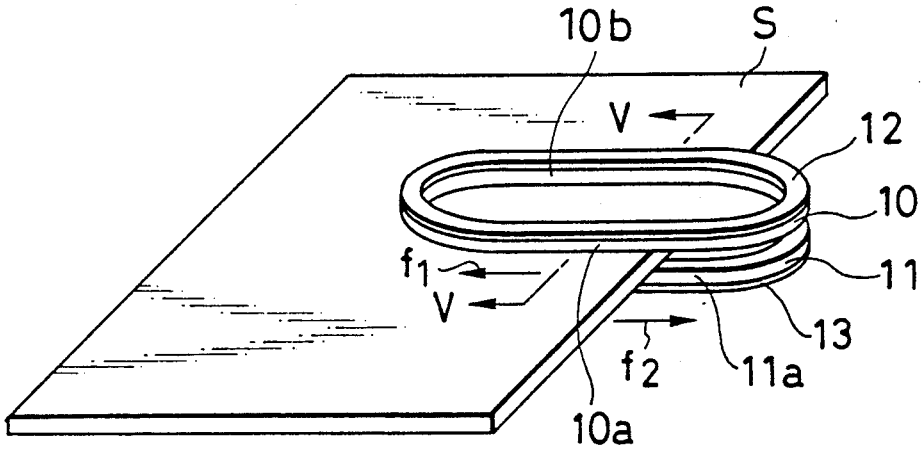
FIG. 4 PRIOR ART
FIG. 4 is a perspective view showing a schematic structure of another conventional sheet feeding device.
Figure 5:
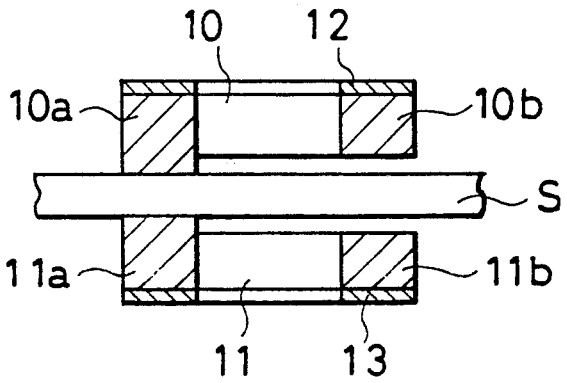
FIG. 5 PRIOR ART
FIG. 5 is a sectional view of the sheet feeding device shown in FIG. 4 along the line V—V therein.

Variable pressure applying means in accordance with sheet properties such as sheet thicknesses and materials in this embodiment comprises the supporting member 6 both ends of which are supported, and the electro-mechanical energy conversion element 14 arranged on the supporting member 6. However, other members may be used as these constituting members. The present invention is also applicable to the sheet feeding device having the vibration members shown in FIG. 4, as a matter of course.

According to the present invention, as has been described above, all problems posed by the conventional sheet feeding devices can be solved, and there is provided a sheet feeding device capable of efficiently feeding sheets having different properties.

What is claimed is:

1. A sheet feeding device comprising:

a pair of vibration members provided so as to clamp a sheet;

an electro-mechanical energy conversion element provided on said vibration members, said electro-mechanical energy conversion element respectively generating a travelling wave in said vibration members in response to electrical signal applied thereto; and means for changing pressure force between said vibration members and the sheet in accordance with a characteristic of the sheet.

2. A sheet feeding device according to claim 1, wherein said means for changing pressure force includes a supporting member for supporting one of said vibration members and means for elastically deforming said supporting member so as to change the pressure force between one of said vibration members and the sheet.

3. A sheet feeding device according to claim 2, wherein said elastically deforming means includes an electro-mechanical energy conversion element responsive to an applied electrical signal.

4. A sheet feeding device, comprising:

at least one vibration member that is provided in contact with a sheet to be fed and that generates a vibration to feed the sheet therein in response to an applied electrical signal; and means for changing pressure force between said vibration member and the sheet in accordance with a characteristic of the sheet.

5. A sheet feeding device according to claim 4, further comprising a supporting member for supporting said vibration member at a predetermined position.

6. A sheet feeding device according to claim 5, wherein said means for changing pressure force is provided on said supporting member.

7. A sheet feeding device according to claim 4, wherein said means for changing pressure force includes an electro-mechanical energy conversion element that generates deflection in response to an applied electrical signal.

8. A sheet feeding device according to claim 4, wherein said energy conversion element includes a piezoelectric element.

9. An actuator for feeding a sheet, comprising:

at least one vibration member that is provided directly in contact with a sheet to be fed and that generates a vibration to feed the sheet therein in response to an applied electrical signal; and means for changing pressure force between said vibration member and the sheet in accordance with a characteristic of the sheet.

10. An actuator according to claim 9, further comprising a supporting member for supporting said vibration member at a predetermined position.

11. An actuator according to claim 9, wherein said means for changing pressure force is provided on said supporting member.

12. An actuator according to claim 9, wherein said means for changing pressure force includes an electro-mechanical energy conversion element that generates deflection in response to an applied electrical signal.

* * * * *

UNITED STATES PATENT AND TRADEMARK OFFICE

CERTIFICATE OF CORRECTION

PATENT NO. : 5,085,423

DATED : February 4, 1992

INVENTOR(S) : NISHIMOTO, ET AL.

It is certified that error appears in the above-identified patent and that said Letters Patent is hereby corrected as shown below:

COLUMN 1

Line 4, "INVENTION:" should read --INVENTION--.

COLUMN 2

Line 15, "o" should read --on--; and
Line 38, "flexture" should read --flexure--.

COLUMN 3

Line 9, "ca" should read --can--; and
Line 12, "DRAWINGS:" should read "DRAWINGS--.

COLUMN 4

Line 61, "claim 9," should read --claim 10,--.

Signed and Sealed this

Fifteenth Day of June, 1993

*Attest:*

Michael K. Kirk

MICHAEL K. KIRK

*Attesting Officer*

*Acting Commissioner of Patents and Trademarks*